US007956309B2

(12) United States Patent
Kim et al.

(10) Patent No.: US 7,956,309 B2
(45) Date of Patent: Jun. 7, 2011

(54) COOKING APPARATUS

(75) Inventors: Hyoung Jun Kim, Seoul (KR); Seung Jo Baek, Gwangmyeong-si (KR); Byeong Wook Park, Gwangmyeong-si (KR); Young Jun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 673 days.

(21) Appl. No.: 11/779,589

(22) Filed: Jul. 18, 2007

(65) Prior Publication Data

US 2008/0185374 A1 Aug. 7, 2008

(30) Foreign Application Priority Data

Feb. 7, 2007 (KR) ..... 10-2007-0012609
Feb. 7, 2007 (KR) ..... 10-2007-0012610

(51) Int. Cl.
*H05B 3/68* (2006.01)

(52) U.S. Cl. ..... 219/452.12; 219/455.12

(58) Field of Classification Search ..... 219/443.1–468.2
See application file for complete search history.

(56) References Cited

U.S. PATENT DOCUMENTS

| | | | | | |
|---|---|---|---|---|---|
| 1,393,368 | A | | 10/1921 | Henry | |
| 2,161,793 | A | * | 6/1939 | Beaucolin | 219/454.12 |
| 2,262,507 | A | * | 11/1941 | Lightfoot | 219/453.13 |
| 2,875,313 | A | | 2/1959 | King | |
| 3,072,775 | A | | 1/1963 | Ammerman et al. | |
| 3,355,574 | A | * | 11/1967 | Bassett, Jr. | 219/452.11 |
| 4,168,423 | A | | 9/1979 | Gilreath | |
| 4,393,299 | A | * | 7/1983 | McWilliams | 219/458.1 |
| 4,645,911 | A | * | 2/1987 | Husslein | 219/462.1 |
| 5,780,817 | A | * | 7/1998 | Eckman et al. | 219/452.12 |

FOREIGN PATENT DOCUMENTS

| | | |
|---|---|---|
| DE | 42 42 928 | 6/1994 |
| DE | 10 2004 023 847 A1 | 12/2005 |
| EP | 0 300 548 B1 | 1/1989 |
| EP | 0 373 706 B1 | 6/1990 |
| EP | 0 556 892 A1 | 8/1993 |
| FR | 2 481 560 | 10/1981 |
| GB | 2 161 348 A | 1/1986 |
| KR | 2000-0031770 | 6/2000 |
| KR | 10-2004-0071018 | 8/2004 |
| KR | 10-0518975 | 10/2005 |
| WO | WO 96/03610 | 2/1996 |

OTHER PUBLICATIONS

International PCT Search Report dated Sep. 24, 2008.
International Search Report for PCT/KR2007/005481 dated Aug. 28, 2008.
Korean Office Action for KR Application No. 10-2007-0012607 dated Dec. 19, 2007.
Korean Office Action for KR Application No. 10-2007-0012609 dated Jul. 31, 2008.
Korean Office Action for KR Application No. 10-2007-0012610 dated Jul. 31, 2008.
European Search Report issued in EP Application No. 07768733.3 dated Feb. 11, 2011.

* cited by examiner

*Primary Examiner* — Sang Y Paik
(74) *Attorney, Agent, or Firm* — KED & Associates, LLP

(57) ABSTRACT

A burner for a glass top stove includes a heating element, and a reflector. The reflector is shaped to reflect heat and light emitted down and to the sides of the heater back up to the glass top of the burner. The reflector is shaped to form multiple images of the heater on the glass plate. This ensures uniform heating of the glass plate. It also causes a user to believe that there are more heaters than are actually mounted on the burner.

18 Claims, 11 Drawing Sheets

COOKING APPARATUS

This application claims the benefit of the Korean Patent Application No. 10-2007-0012609, filed on Feb. 7, 2007, and Korean Patent Application No. 10-2007-0012610, filed on Feb. 7, 2007, which are hereby incorporated by reference for all purposes as if fully set forth herein.

BACKGROUND

1. Field

The present application discloses a cooking apparatus capable of cooking food using a heating element. More specifically, the present application is directed to a reflector to be placed behind the heating element of a cooking apparatus.

2. Background

There are various types of cooking devices, such as a microwave oven, an oven, and a stove or cooktop. The stove or cooktop generally heats food contained in a cooking vessel by heating the vessel using a burner.

An electric cooktop generally includes a glass plate on which cooking vessels are put; at least one heating element disposed below the glass plate and operated by means of electricity; and a reflector disposed behind and around the heating element to reflect the heat and radiation emanated by the heating element.

Typically, the heating elements used in an electric cooktop emanate heat along with light. The glass plate located over the heating element is usually formed of materials capable of transmitting the light output by the heating elements. Therefore, the light output by the heating elements is transferred outside the cooktop through the glass plate so that the user can view the light. This helps the user to acknowledge that the heating elements are operating.

In some related art cooktops, the portion of the glass plate directly over the heating elements may be illuminated such that some portions are lighted, and other portions remain dark. As a result, the user may feel that the glass plate is not uniformly heated. In other words, even though the glass plate is sufficiently heated by the heater, the user may feel that the power of the heater is not sufficient because of the light from the heater only shows up as a narrow ring. Further, the user may think that the dark portion of the glass plate is not heated. This raises a risk of accidents because users might put their hands on the dark portions of the glass plate.

Related Art cooktops can also suffer from overheating of localized portions of the glass plate due to concentrated heat and light being reflected from the reflector of existing cooktops onto only selected portions of the glass plate. Further, the heat and light produced by the heater of related art cooktops may be reflected from the reflector back to the heater itself. As a result, the heater can be overheated and broken. In addition, because the reflectors of related art cooktops are relatively inefficient, the related art cooktops do not satisfy consumers in terms of thermal efficiency and responsiveness.

BRIEF DESCRIPTION OF THE DRAWINGS

The embodiments will be described in detail with reference to the following drawings, in which like reference numerals refer to like elements, and wherein.

DETAILED DESCRIPTION

Figure 1:
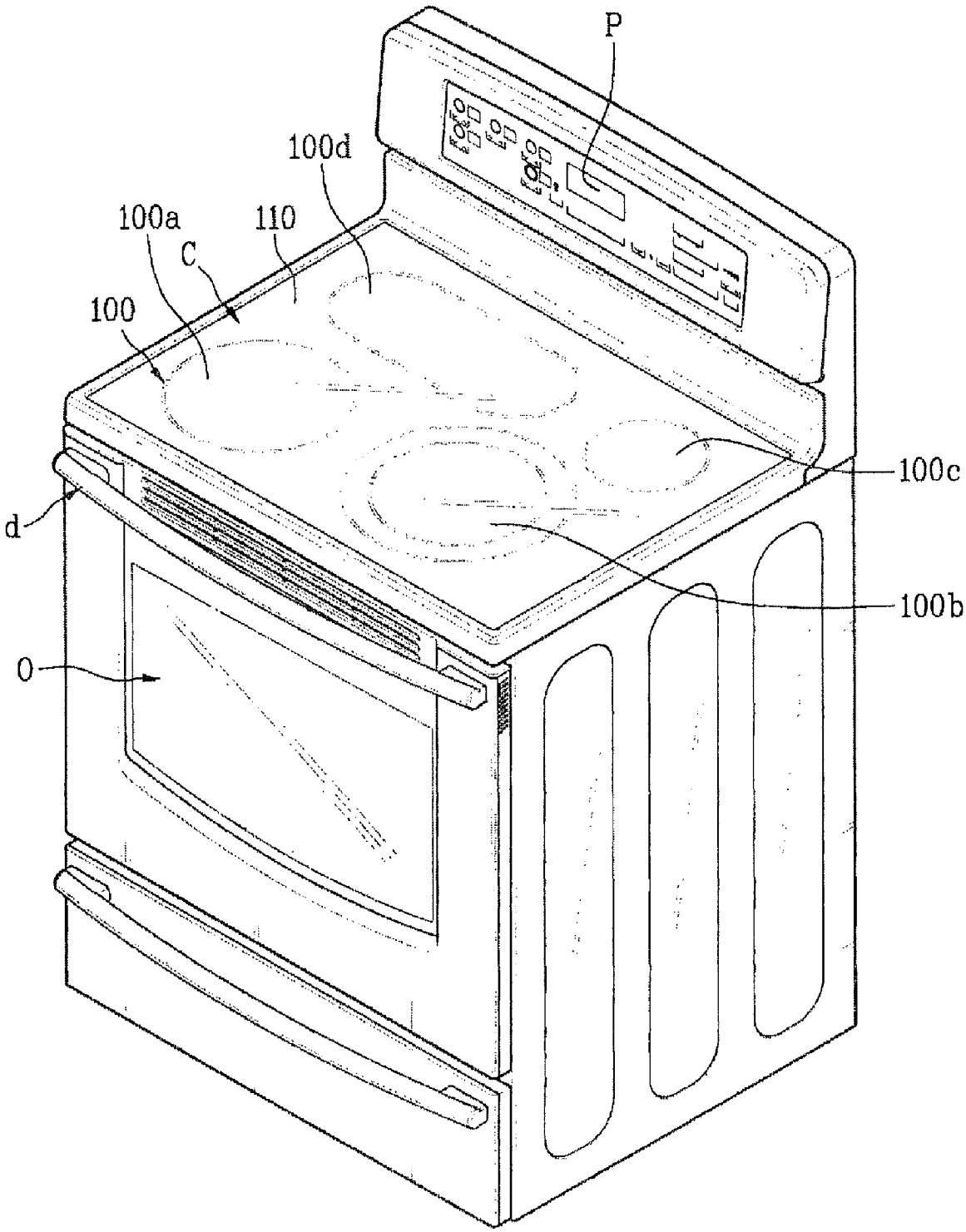
FIG. 1 is a perspective view showing a stove having an oven and an electric cooktop.

FIG. 1 is a perspective view of a stove with an electric cooktop. The cooktop (C) is provided with a plurality of burners 100*a*, 100*b*, 100*c*, and 100*d*. In addition, the stove can further comprise an oven (O) opened and closed by means of a door (d) disposed below the cooktop (C). The oven (O) can be provided with a heater operated by means of electricity, as well as a magnetron that irradiates microwave into the cooking room of the oven (O). A control panel P comprises a controller for controlling the cooking apparatus.

Although a stove is illustrated, a burner of a cooktop could also be provided as a stand-alone item. Such a burner could also be built into a kitchen table for convenience of a user.

On the upper surface of the cooktop (C) is provided a glass plate 110. The glass plate 110 can be made of glass, ceramic or other similar materials. Indication lines on the plate 110 can be used to inform a user of the positions of the underlying heating elements. The plate 110 can be formed in a plane, without raised bumps or indentations, to provide for easy cleaning.

The plurality of burners 100*a*, 100*b*, 100*c*, and 100*d* are provided under the plate 110. The plurality of burners 100*a*, 100*b*, 100*c*, and 100*d* can be formed to have the same or different sizes/shapes so that food can be cooked using different sized vessels. At least one of the burners can be elongated to efficiently heat an elongated cooking vessel. Although the sizes and shapes of the burners 100*a*, 100*b*, 100*c*, and 100*d* may be different; the basic structures thereof are substantially the same.

Figure 2:
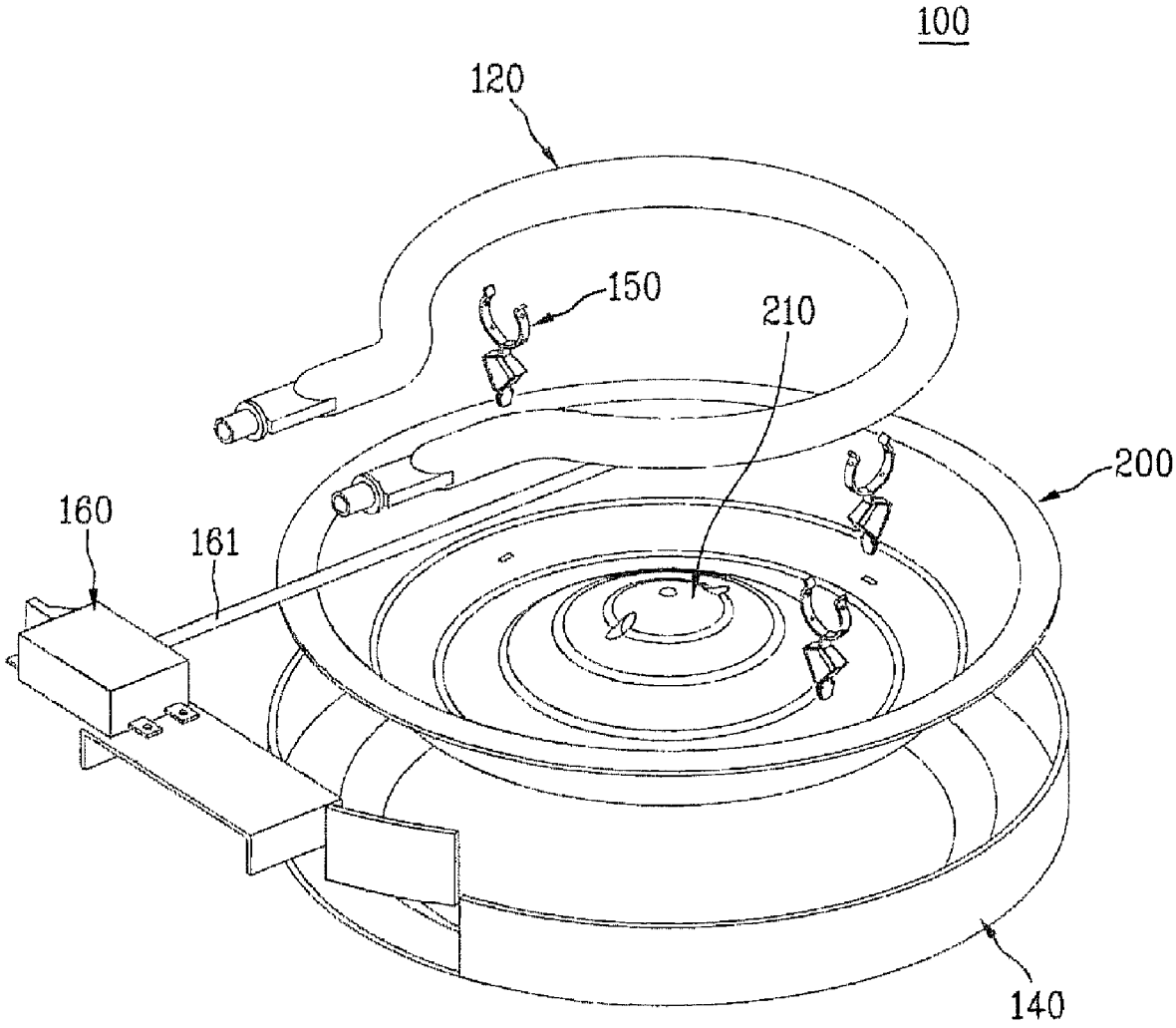
FIG. 2 is an exploded perspective view showing one embodiment of a burner that can be mounted in the cooking apparatus of FIG. 1.

FIG. 2 shows a first embodiment of a burner which would be positioned under a glass plate of a cooktop. Hereinafter, for convenience of explanation, the burners 100*a*, 100*b*, 100*c*, and 100*d* are collectively referred to as a burner 100. The burner 100 comprises a heat-generating heater 120 and a reflector 200 that reflects heat and light emitted from the heater 120 to the glass plate 110.

Preferably, the heater uses an electric element that is heated by electricity. In preferred embodiments, a carbon heater can be used. A carbon heater has a structure where a resistance heating element formed of carbon is positioned at the center of an airtight quartz tube. Both ends of the quartz tube are finished to be airtight, and the heating element is electrically connected to an outer electrode of the burner by means of a connector. The inside of the quartz tube is filled with inert gas to prevent oxidation of the carbon resistance heating element.

To efficiently use space, it is preferable that the heating element is formed in a circular shape or a horseshoe's shape (Ω). This shape also corresponds to the shapes of typical cooking vessels. However, the heating element is not limited to these shapes, and can be formed a straight bar shape, or an oval shape. Therefore, there are no restrictions on the shape of heating elements.

The reflector 200 is formed to surround the circumference of the heating element 120 so that it can reflect the light and heat generated from by the heating element 120 up to the glass plate 110. The reflector 200 can be formed of, for example, aluminum and other reflective materials. The reflector can be subjected to special processes, such as a hard face process, etc., to provide high heat resistance and reflectivity.

A base plate 140 surrounding the bottom surface and the side of the reflector 200 can be provided below the reflector 200 as shown in FIG. 2. The base plate 140 serves as a case for the burner 100 and serves to prevent the heat transferred from the reflector 200 from being transferred to other portions of the cooking apparatus and outside the cooking apparatus.

Both ends of the heating element 120 can be exposed outside the reflector 200 and the base plate 140 so that they can be connected to electrical terminals. A thermostat 160 can be used to prevent the heater 120 from overheating. The operating bar 161 of the thermostat 160 can be positioned inside the reflector 200 after penetrating through the reflector 200. If the heater 120 gets too hot, the operating bar 161 operates the thermostat 160 so that the electric supply to the heater 120 is stopped, making it possible to efficiently prevent a breakdown of the heater due to overheating.

Meanwhile, the burner 100 is provided with one or more supporters 150, as shown in FIG. 2. The supporters 150 support the heating element 120 so that it is spaced from the reflector 200 and so that the heater 120 does not sag downward.

When electricity is supplied to the heater 120, the heater generates light and heat. Some of the light and heat is directly diffused toward the glass plate. The majority of the remaining light and heat is reflected by means of the reflector 200 so that the light and heat is basically all directed toward the glass plate 110.

Some of the heat and light directed to the glass plate 110 passes through the glass plate to directly heat a cooking vessel and/or food put on the glass plate. The remaining heat and light heats the glass plate so that a cooking vessel and/or food put on the glass plate 110 is heated by means of thermal conduction.

The glass plate 110 is made of material with some degree of transparency. Accordingly, the user can view one or more images of the heater 120 that are formed on the glass plate 110 by the light corning directly from the heating element and the light being reflected from the reflector 200. The images of the heater 120 on the glass plate 110 make it possible to determine whether the heater 120 is operating and whether the glass plate 110 is heated to some degree.

If the images of the heater occupy a wide area of the glass plate 110, or are formed at several places, the user will feel that several heaters are being used, that the power of the heater is sufficient, and that the glass plate 110 is uniformly heated. In order to obtain such effects, the reflector is formed to reflect the light and heat from the heater onto the glass plate at multiple locations so that several images of the heater are formed on the glass plate.

Figure 3A:
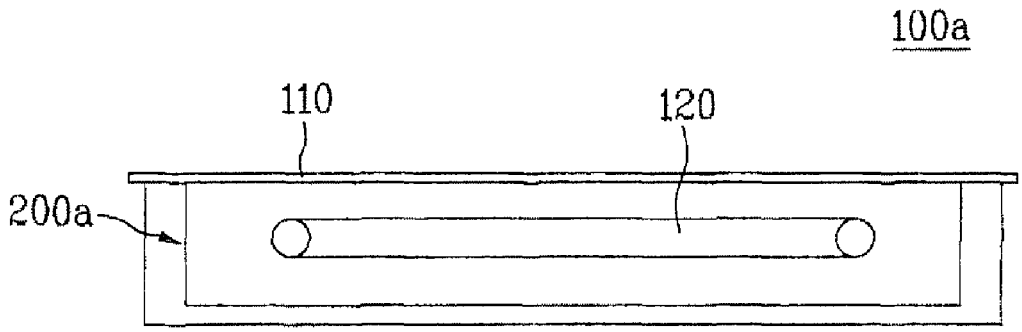
FIGS. 3A and 3B are cross-sectional and plan views of a burner of a cooktop when a reflector is flat.
Figure 3B:
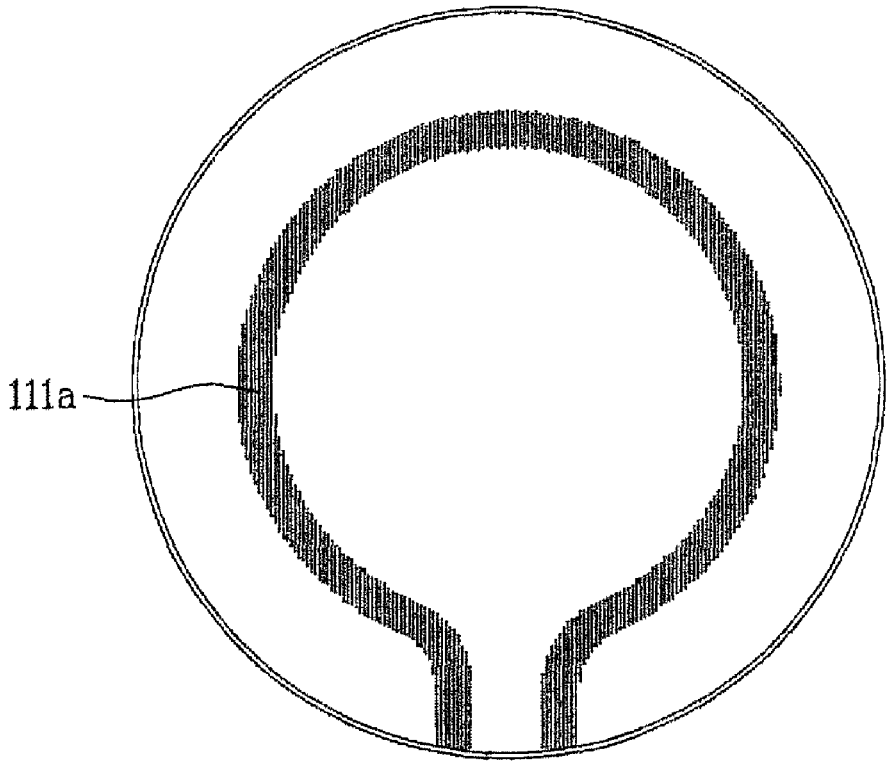

When the reflector 200*a* has a vertical side wall and a flat bottom surface, as shown in FIGS. 3A and 3B, one image 111*a* of the heating element is formed on the glass plate. Therefore, the user can view only the one image. As noted above, if the user sees only one image of the heating element, the user may not think that the heating element has sufficient heating power, and that the heat from the element is not uniformly distributed.

In the various embodiments described below, the reflector utilizes inclined surfaces to reflect the light in several directions so that several images of the heater can be formed on the glass plate 110. In preferred embodiments, the reflectors include side portions that are inclined relative to the glass plate, rather than being vertical. More specifically, the surface of the reflector adjacent the side portion of the heater can form an arc having a center of curvature behind the reflector. In other words, the side surfaces of the reflector may be convex.

Figure 4A:
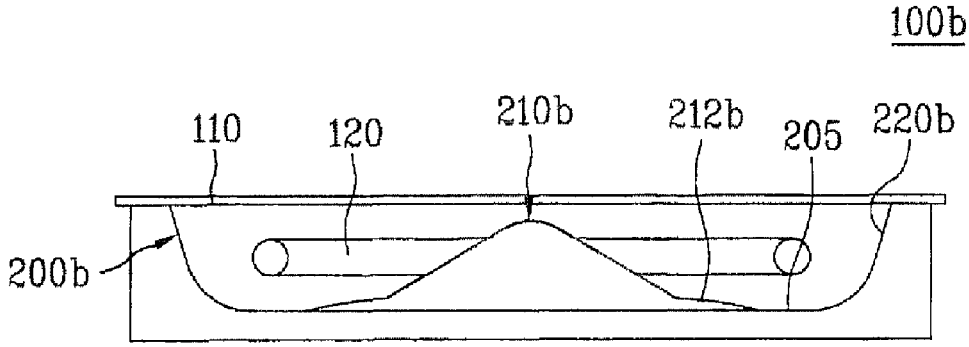
FIGS. 4A and 4B are cross-sectional and plan views of a burner when the center of the reflector is provided with a dome.
Figure 4B:
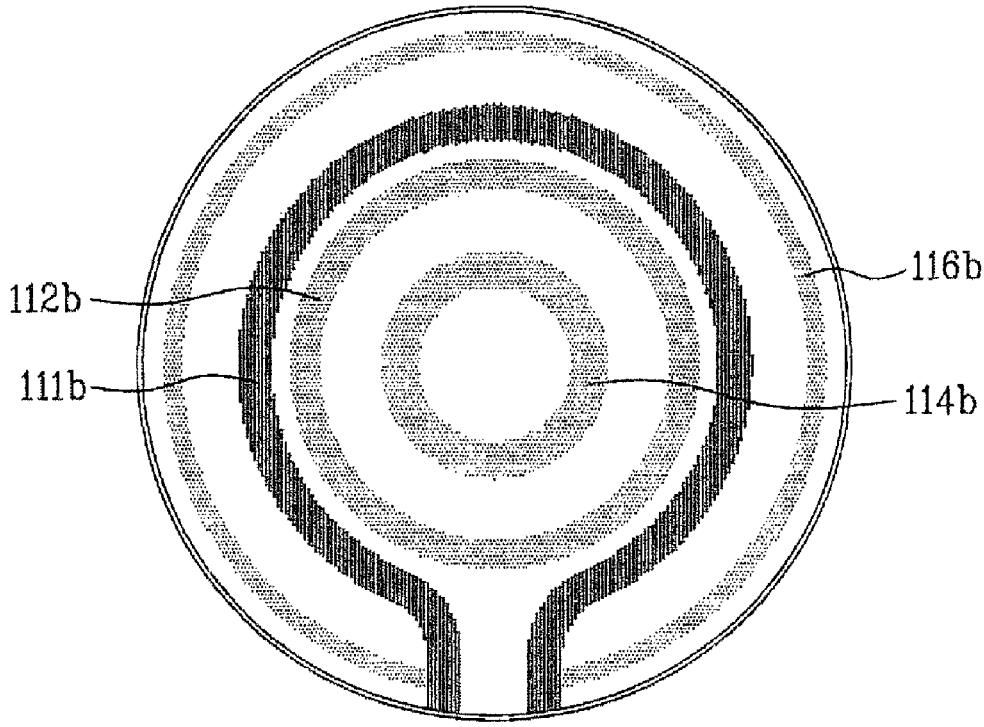

In the embodiment shown in FIGS. 4A and 4B, the heater 120 takes a ring shape. The bottom center of the reflector 200*b* can be formed with a dome 210*b* projected upward toward the space at the center of the heater 120. In this embodiment, the top of the dome 210*b* is higher than the top of the heater 120.

The lower circumference of the dome has a first band convexly projected towards the heater 120. The side wall 220*b* of the reflector 200*b* is inclined downward and inward to form a concave shape. Further, it is preferable that the point where the side wall 220*b* of the reflector meets the bottom thereof is rounded, not angled. Note, the first band 212*b* formed along the lower circumference of the dome 210*b* forms a reflective surface with a different slope than the neighboring portions of the reflector 200*b*.

With a reflection as shown in FIG. 4A, four images of the heater 120 are formed on the glass plate, as shown in FIG. 4B. The brightest first image 111*b* is formed by light directly emitted from the heater 120. The second image 112*b* and third image 114*b*, which appear inside the first image 111*b*, are formed by means of the side of the dome 210*b*. Finally, a fourth image 116*b*, which appears outside the first image 111*b*, and the third image 114*b*, is formed by means of the side of the reflector 220*b*. Because the light is reflected by multiple different reflective surfaces of the reflector 200*b*, multiple images are formed on the glass plate 110.

Figure 5A:
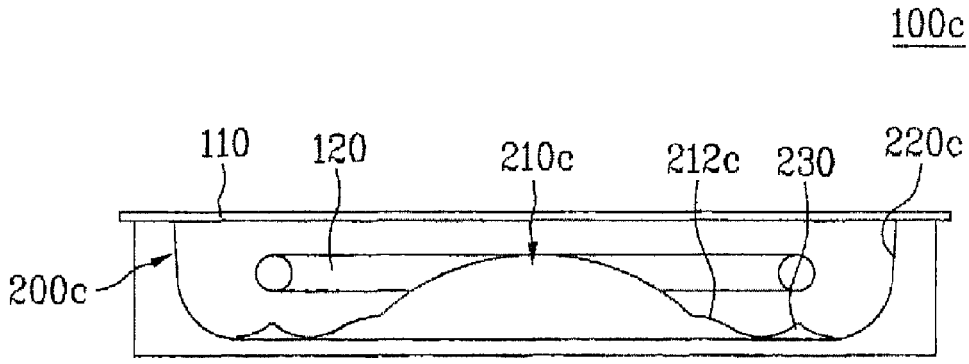
FIGS. 5A and 5B are cross-sectional and plan views of a burner when the center of the reflector is provided with a dome and projections are formed on the dome below the heating element.
Figure 5B:
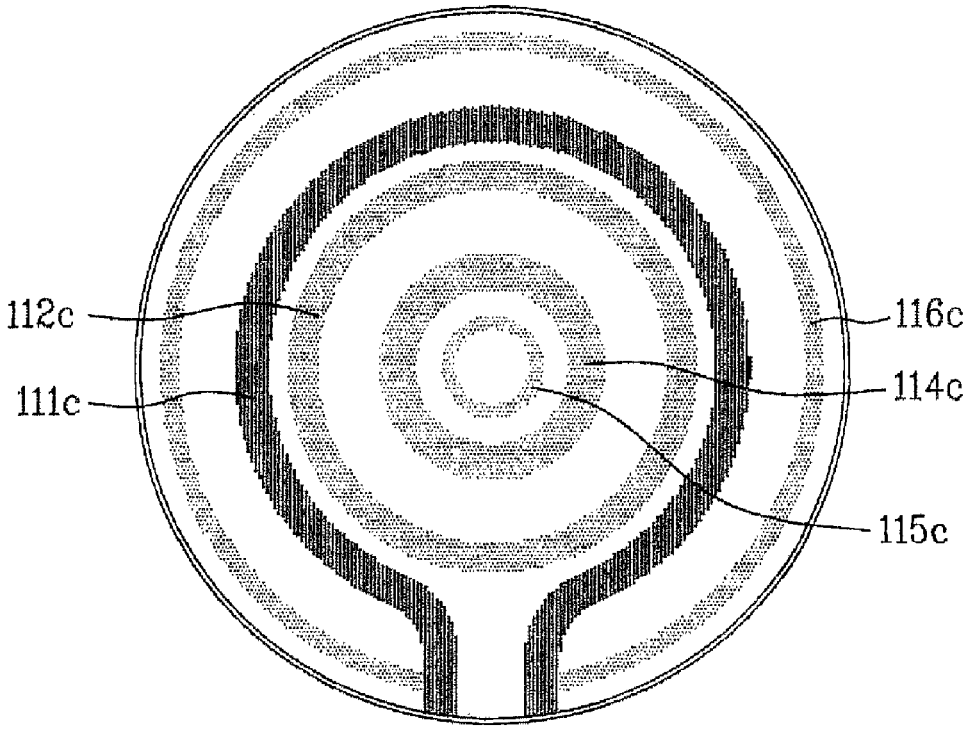

FIGS. 5A and 5B illustrate another embodiment in which the reflector forms more images of the heater. Similarly to the embodiment described above, the center of the bottom of the reflector 200*c* can be formed with a convexly projected dome 210*c*. A first band 212*c* is formed along the lower circumference of the dome 210*c*. The surface 220*c* of the circumference of the reflector 200*c* is inclined and has a concave shape. The upper end of the dome 210*c* has a more shallow rounded upper surface than the upper end of the dome 210*b* of the embodiment in FIGS. 4A and 4B. As a result, the top of the dome 210*c* in this embodiment is approximately level with the upper surfaces of the heater 120. Also, the majority of the upper surface of the dome 210C has an arc shape. The first band 212*c* is convexly formed to have an arc-shaped cross section.

In addition, in the present embodiment an overheating protection portion 230 is disposed on the bottom of the reflector 200*c*, directly below the heater 120. The overheating protection portion 230 is projected from the bottom of the reflector 200*c* between the dome 210*c* and the side 220*c*. The overheating protection portion 230 surrounds the dome 210*c*, as viewed from above. Both sides of the overheating protection portion 230 are concave as shown in FIG. 5A.

In this embodiment, five images of the heater are formed on the glass plate. A first image 111*c*, a second image 112*c*, a third image 114*c*, and a fourth image 116*c* are formed by the portions of the reflector described above in connection with embodiments shown in FIGS. 4A and 4B. A fifth image 115*c* is formed inside the third image 114*c*. The fifth image 115*c* is formed by the rounded upper end of the dome 210*c* and is further formed by disposing the upper end of the dome at the same height as the upper end of the heater.

As shown in FIG. 5, an image of the heater 120 is not formed by means of the overheating protection portion 230. This is because the overheating protection portion 230 is disposed directly underneath the heater 120. The overheating protection portion 230 does not form a further image of the heater 120, but instead reflects the light diffused downward from the heater 120 to other directions to prevent the lower surface of the heater 120 from being heated by means light reflected back up by the reflector 200*c*. This prevents the heater 120 from overheating, and the efficiency of the burner is high. In addition, the overheating protection portion 230 can result in the second image 112*c* and the fourth image 116*c*, which are adjacent to the first image 111*c*, being brighter and more clear.

Figure 6:
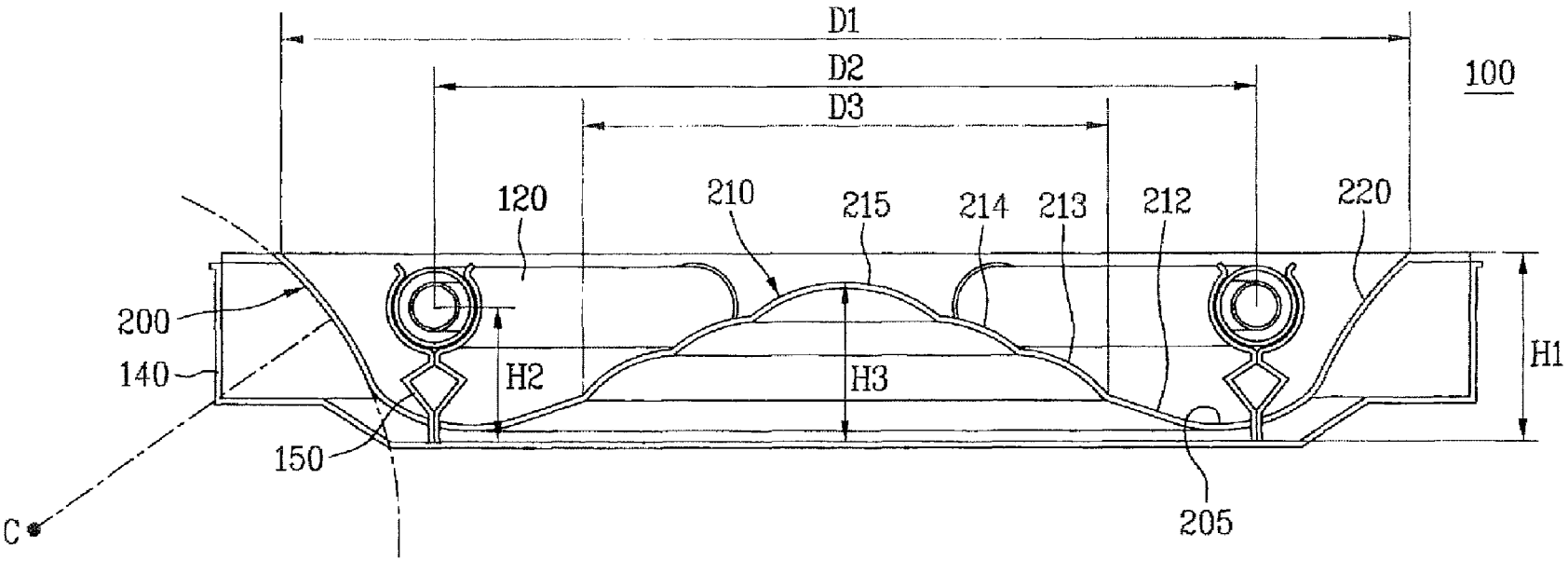
FIG. 6 is a cross-sectional view of a burner structure.

FIG. 6 shows another embodiment of a burner with al an alternate reflector structure. The center of the bottom 205 of the reflector 200 includes a dome 210. The dome 210 is positioned in the middle portion of the heater 120, as viewed from above. The sides of the dome 210 can be provided with a plurality of concentric bands 212, 213, and 214, each of which has a convex shape. The bands 212, 213, and 214 have arc-shaped cross sections, and they are disposed from the lower part of the dome 210 to the upper part thereof.

Also, the reflective surface 220 of the inner circumference of the reflector 200 can be inclined relative to the glass plate 110, and this surface may have a convex shape that projects towards the heater 120. In other words, the center of curvature (C) of the arc is located on a side opposite to the heater 120.

The first band 212 can be disposed along the lower circumference of the dome 210. The second band 213 is disposed above the first band 212, and the third band 214 is disposed between the second band 213 and the upper end 215 of the dome 210. The upper end 215 of the dome 210 can be smoothly and roundly formed, and it has an upper surface disposed between the upper and lower surfaces of the heater 120. Preferably, the upper end 215 of the dome 210, which is located at height H3, is disposed higher than the center of the heater 120, which is at height H2.

Preferably, the ratio of the diameter D2 of the heater 120 to the diameter D1 of the reflector 200 is approximately 0.5 to 0.8. Preferably, the ratio of the height H2 of the center of the heater 120 to the overall height H1 of the reflector is approximately 0.4 to 0.8. Preferably, the ratio of the height of the dome H3 to the overall height H1 of the reflector 200 is approximately 0.5 to 0.9. And, preferably the diameter D3 of the dome 210 to the diameter D2 of the heater 120 is approximately 0.5 to 0.9. Herein, the diameter D3 of the dome 210 is measured without taking the first band 212 into account.

Although the overheating protection portion 230 is not shown in FIG. 6, the bottom of the reflector can be provided with an overheating protection portion 230, like the one shown in FIG. 5A.

Figure 7A:
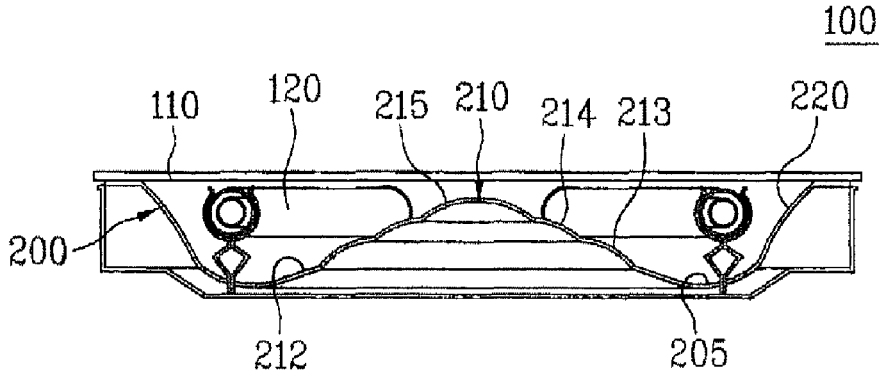
FIGS. 7A and 7B are cross-sectional and plan views of a burner when a reflector as shown in FIG. 6 is provided under the heating element.
Figure 7B:
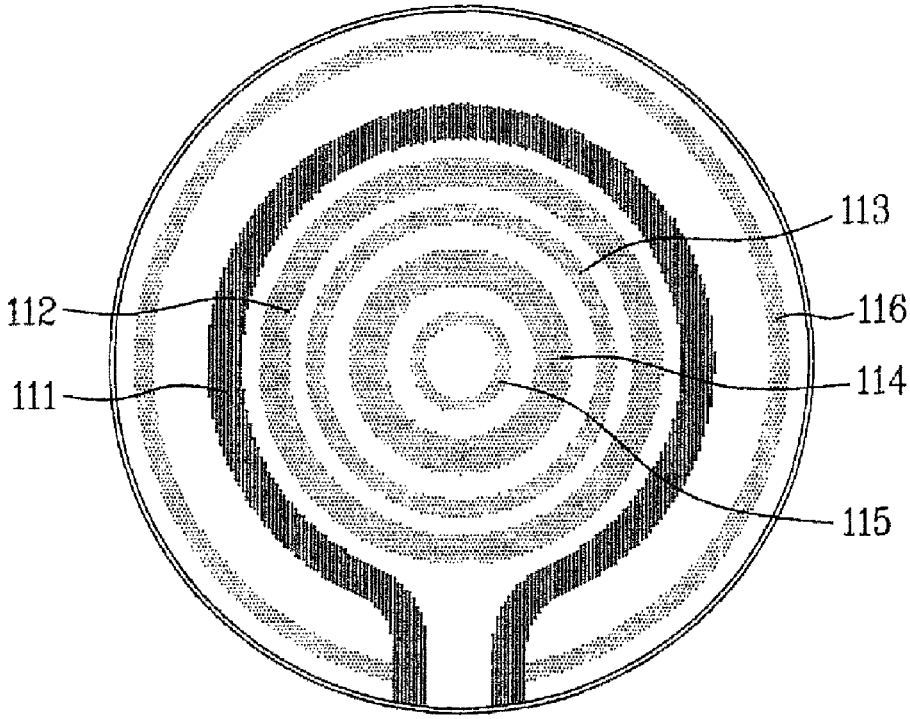

The reflector shown in FIG. 6 generates six images of the heater on the glass plate, as shown in FIG. 7B. The first image 111 is formed by means of light directly emitted from the heater 120. The second image 112, which appears just inside the first image 111, is formed by means of the first band 212. The third image 113, which appears inside the second image 112, is formed by means of the second band 213. The fourth image 114, which appears inside the third image 113, is formed by means of the third band 214. The fifth image 115, which appears inside the fourth image 114, is formed by means of the upper end of the dome 210. Finally, the sixth image 116, which appears outside the first image 111, is formed by means of the convex side 220.

When six images of the heater are formed on the glass plate, the user will think that more heaters than the single heater mounted in the burner 100 are present, and the user will more easily believe that the glass plate 110 is uniformly heated. In fact, because the light and heat diffused from the heater 120 is concentrated on several dispersed places on the glass plate 110, the glass plate 110 is more uniformly heated.

Figure 8:
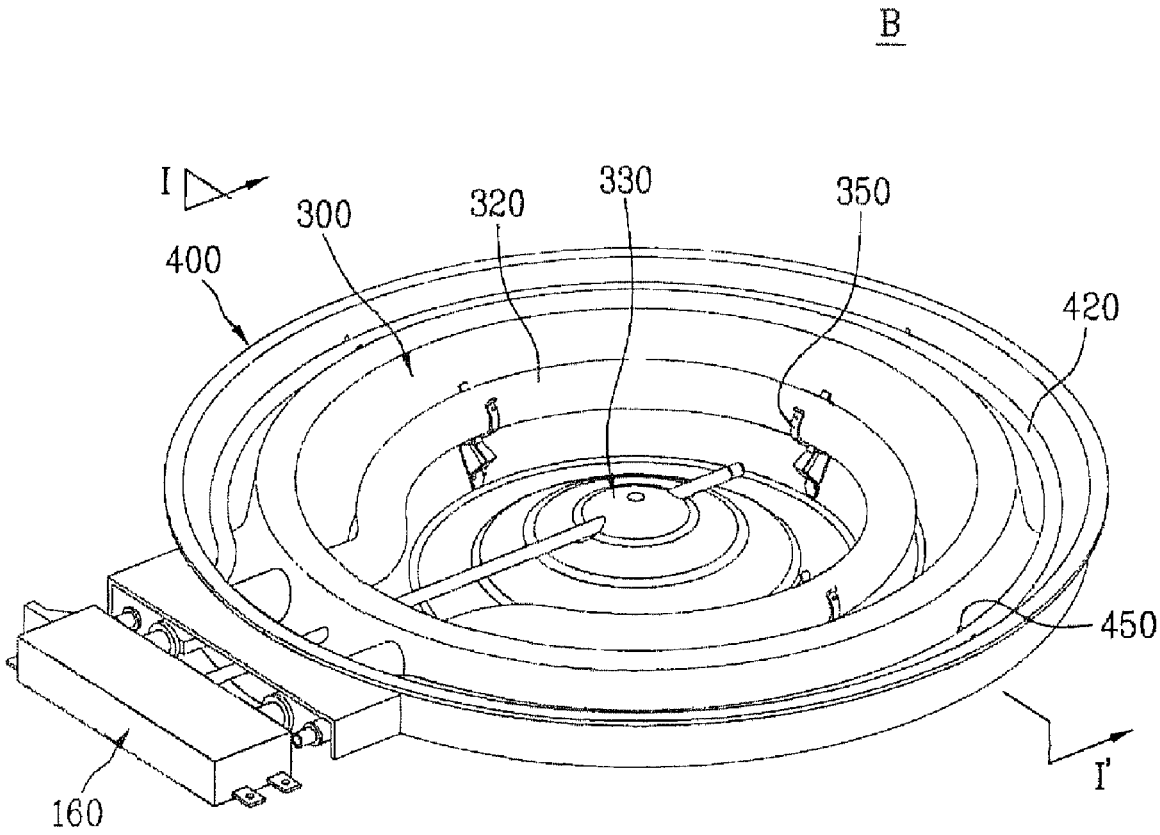
FIG. 8 is a perspective view of a burner according to another embodiment.
Figure 9:
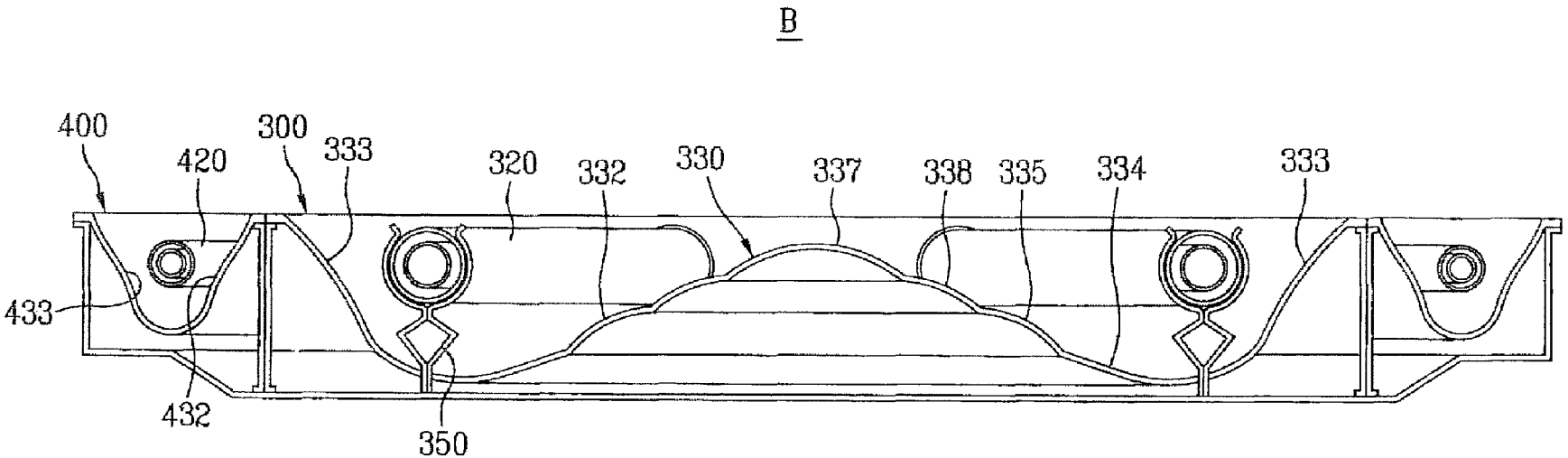
FIG. 9 is a cross-sectional view of the burner in FIG. 8 taken along section line I-I'line.
Figure 10:
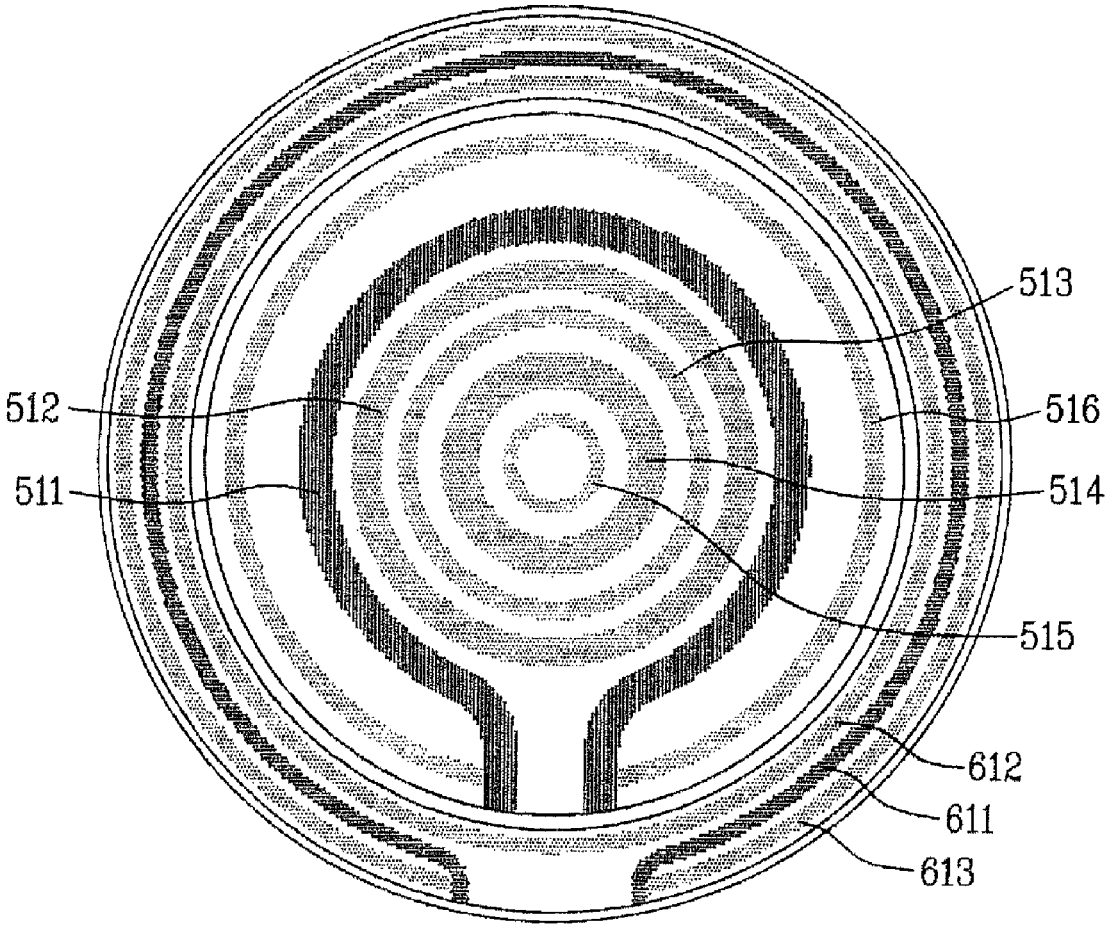
FIG. 10 is a plan view showing the pattern formed on the glass plate by the burner shown in FIG. 9.

FIGS. 8 to 10 show another embodiment which has two heating elements. The burner includes a first heater 320 and a second heater 420. The first heater 320 and the second heater 420 can both be the carbon heaters described above. In this embodiment, the first heater 320 and the second heater 420 are ring shaped or horseshoe shaped (Ω). Herein, the first heater 320 is disposed at the center of the burner and the second heater 420 is disposed outside the first heater 320, and concentric with the first heater 320.

In some embodiments, the first heater 320 and the second heater 420 can be controlled independently. In other words, the first heater 320 and the second heater 420 can be operated simultaneously, or only one heater could be used. This makes it possible to obtain a proper power required for cooking and the user can control the heat used and the heat-generating area of the burner.

Because it is often necessary to cook only a small amount of food using a small cooking vessel, it is preferable to design the burner B so that it is capable of efficiently heating the small cooking vessel. At the same time, the burner must be capable of heating a large cooking vessel, if necessary.

To satisfy the above demands, the power of the first heater 320 can be designed to be higher than the power of the second heater 420. Preferably, the first heater could be designed to deliver 60% of the total heat of the burner, and the second heater could be designed to deliver the other 40% of the total heat of the burner. Then, when cooking food using a small cooking vessel, even when only the first heater 320 is operated, sufficient power can be obtained. When it is necessary to cook food using a large cooking vessel, both the first heater 320 and the second heater 420 are operated, making it possible to obtain the large power requited to cook a large amount of food.

In this embodiment, a plurality of reflectors are disposed below the plurality of heaters. A first reflector 300 is disposed below the first heater 320 to reflect the light and heat from the first heater 320 to the glass plate 110. A second reflector 400 is disposed below the second heater 420 to reflect the light and heat from the second heater 420 to the glass plate 110. The first reflector 300 and the second reflector 400 can be formed of for example, aluminum material and can be subjected to special processes, such as a hard face process, etc., to provide high heat resistance and reflectivity.

One or more first heater supporters 350 and one or more second heater supporters 450 are provided between the first and second heaters and the first and second reflectors to prevent sagging of the first heater 320 and the second heater 420, and to maintain the positions of the first heater 320 and the second heater 420.

The first reflector 300 comprises a first reflective surface 332 reflecting the heat and light diffused to one side of the first heater 320 and a second reflective surface 333 reflecting the heat and light diffused to other side of the first heater 320. Because, the first heater 320 is ring shaped, the bottom center of the first reflector 300 can be formed to have a dome 330 projected toward the center of the first heater 320. The side wall forming the inner circumference of the first reflector 300 can form the second reflective surface 333. The side wall can be inclined relative to the glass plate 110, and be convex. Further, this surface may have more than one slope. It is preferable that the first reflective surface 332 and the second reflective surface 333 are both inclined relative to the glass plate 110.

The first reflector 300 may be substantially the same as the reflectors described above reference to FIGS. 4A and 7B, and thus a detailed description thereof will be omitted.

As shown in FIGS. 8 and 9, because the second heater 420 is formed at the outer circumference of the first heater 320 in a ring shape, the second reflector 400 can also be formed in a ring shape and be disposed around the outer circumference of the first reflector 300. In some embodiments, the first and second reflectors may be separate, or at least separately formed. In other embodiments, the first and second reflectors can be part of the same unitary structure. When the first reflector 300 and the second reflector 400 are formed separately, the manufacture thereof is easier, and manufacturing defects rarely occur. When the first reflector 300 and the second reflector 400 are integrally formed, manufacturing defects are more common.

The second reflector 400 comprises a third reflective surface 432 reflecting the heat and light diffused to one side of the second heater 420 and a fourth reflective surface 433 reflecting the heat and light diffused to the other side of the first heater 420. The third reflective surface 432 and the fourth reflective surface 433 can have a shape similar to the first reflective surface 332 and the second reflective surface 333, and they can be inclined relative to the glass plate 110.

Preferably, the third reflective surface 432 and the fourth reflective surface 433 are not formed to have a constant slope. Instead they are formed to have at least two different slopes. To this end, the third reflective surface 432 and the fourth reflective surface 433 can be formed to project toward the second heater 420, and thus be convex. Alternatively, they can be formed to have curved reflective surfaces with different slopes.

Also, the bottom surface of the second reflector 400 can be provided with an overheating protection portion, as described above in connection with the foregoing embodiments.

FIG. 10 shows the images of the heater that are formed on the glass plate by the present embodiment. A first image 511 is formed by means of the light directly emitted from the first heater 320. A second image 512, which appears inside the first image 511, is formed by means of the first band 334. A third image 513, which appears inside the second image 512, is formed by means of the second band 335. A fourth image 514, which appears inside the third image 513, is formed by means of the third band 338. A fifth image 515, which appears inside the fourth image 514, is formed by means of the upper end 337 of the dome 330. A sixth image 516, which appears outside the first image 511 is formed by means of the second reflective surface 333 of the first reflector 300.

A seventh image 611 is formed by means of the light directly emitted from the second heater 420. An eighth image 612, which appears inside the seventh image 611, is formed by means of the third reflective surface 432 of the second reflector 400. Finally, a ninth image 613, which appears outside the seventh image 611, is formed by means of the fourth reflective surface 433.

Although the burner B only has two heaters 320 and 420, a number of images of the heaters are displayed on the glass plate 110 by means of the plurality of reflective surfaces of the first reflector 300 and the second reflector 400.

In yet other alternative embodiments requiring more heating power, a third heater (not shown) and a third reflector (not shown) could be provided. The third heater would be larger than the second heater 420 but it would have approximately the same shape as the second heater 420. Likewise, the third second reflector would be similar to the second reflector. When the second and third heaters and reflectors have substantially the same shape, it keeps design and manufacturing costs low, and productivity is improved.

Although the above-described embodiments have circular and ring shaped reflectors, alternative embodiments may have other reflectors with other shapes.

Figure 11:
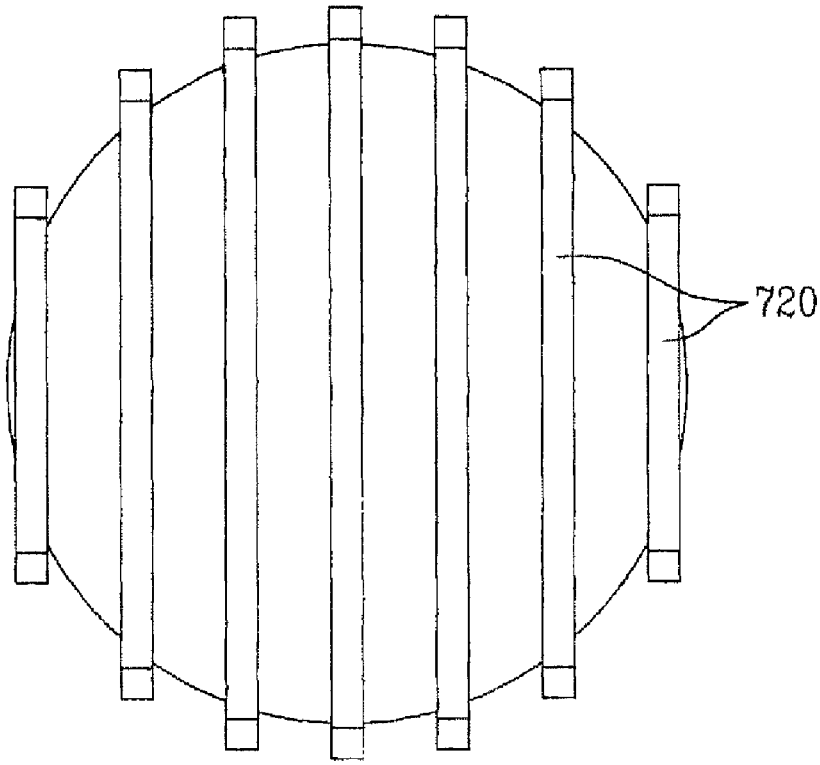
FIG. 11 is a plan view of a burner according to another embodiment.
Figure 12:
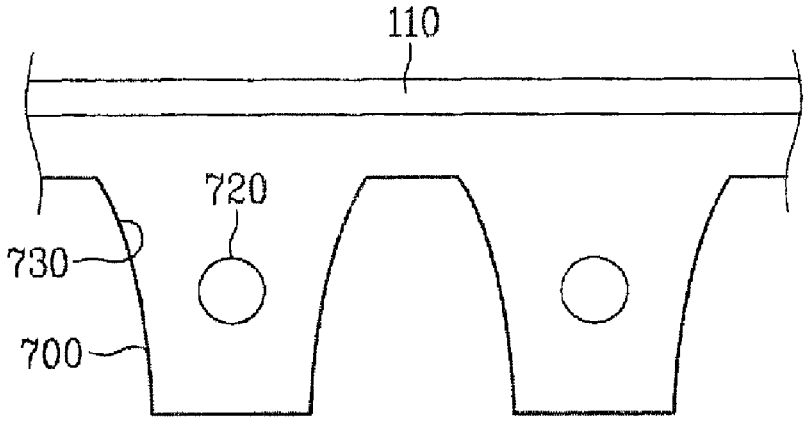
FIG. 12 is a cross-sectional view of the burner of FIG. 11.

FIGS. 11 and 12 are views showing a burner when the heater is formed in a straight shape. The burner of this embodiment comprises a glass plate 110 (see FIG. 1), a plurality of straight heaters 720 disposed below of the glass plate 110, and a reflector reflecting the heat and light of the heaters 720 to the glass plate 100. The reflector 700 is formed to reflect the light from the heaters 720 to the glass plate 110 so that multiple images of each of the heater elements are formed on the glass plate 110.

The reflector 700 is formed with reflective surfaces 730 at side portions of the heater elements 720. The reflective surfaces 730 are inclined relative to the glass plate 110. In order to form the multiple images of the heater elements 720, the reflective surfaces 730 are arc shaped, and they project toward the heater elements 720, and they can be formed to have different slopes. In other words, the reflective surfaces 730 are convex. Irrespective of the shape of the heater elements 720, it can be appreciated that the reflector 700 can be formed to allow multiple images of the heater to be formed on the glass plate 110.

The carbon heaters described above output a large amount of heat, as compared to the lamp heaters of the prior art. Some of heat generated from the heater is transmitted through the glass plate 110 to directly heat the food or cooking vessel put on the glass plate 110. Some of the remaining heat heats the glass plate 110 and the heated glass plate 110 indirectly heats the cooking vessel through thermal conduction.

The thermal spectrum emitted from a carbon heater and transmitted through the glass plate is broader than the spectrum emitted by prior art kanthal heaters or halogen heaters. Accordingly, with the carbon heater, the radiation energy directly heating the food or cooking vessel which has passed through the glass plate is larger, and efficiency can be improved.

In the above-described embodiments, multiple images of the heater are formed on the glass plate of a burner so that the glass plate can be more uniformly heated, and so that a user will believe that the surface of the glass plate is uniformly heated. This improves consumer satisfaction, make the product more attractive, and prevents accidents.

Also, the overheating protection portions ensure that the heat reflected from the reflector is not reflected directly back at the heater, making it possible to prevent the heater from being overheated.

In addition, when a plurality of heaters are mounted in a burner, the amount of heat and the heat-generating area can be better controlled and conformed to a consumer's demand.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although a number of illustrative embodiments have been described, it should be understood that numerous other modifications and embodiments can be devised by those skilled in the art that will fall within the spirit and scope of the principles of this disclosure. More particularly, various modifications are possible in the component parts and/or arrangements of the subject combinations which would fall within the scope of the disclosure, the drawings and the appended claims. In addition to variations and modifications in the component parts and/or arrangements, alternative uses will also be apparent to those skilled in the art.

What is claimed is:

1. A cooking apparatus, comprising:

a plate upon configured to receive thereon an object to be heated;

a ring shaped heater mounted under the plate; and a reflector positioned at least partially below the ring shaped heater so as to reflect heat and light emitted from the ring shaped heater toward the plate, wherein the reflector comprises a bottom wall;

an outer wall that extends upward and outward from the bottom wall; and a dome that projects upward from a central portion of the bottom wall towards a center of the ring shaped heater such that the dome forms a curved convex shape at the central portion of the bottom wall, with an upwardly curved top of the dome positioned above a top surface of the heater, wherein a center of curvature of the outer wall and a center of curvature of the dome are each located at an outer side of the reflector, the outer side of the reflector being opposite from a side of the reflector facing the heater, and wherein a curvature of the outer wall and a side and top of the dome cause multiple images of the ring shaped heater to be formed on the plate.

2. The cooking apparatus of claim 1, wherein the reflector comprises a reflective surface on an inner side thereof facing the ring shaped heater so as to reflect heat and light emitted from the ring shaped heater toward the plate, wherein a curvature of the outer wall is different from a curvature of the dome such that the outer wall and the dome form separate images of the ring shaped heater on the plate.

3. The cooking apparatus of claim 1, wherein the reflector includes an overheating protection portion located under the heater, and wherein the overheating protection portion prevents heat from being reflected directly back towards the heater.

4. The cooking apparatus of claim 1, wherein the heater comprises a first heater, and the reflector comprises a first reflector, and further comprising:

a second heater operated independently from the first heater, wherein the second heater is mounted under the plate, surrounding the first heater; and a second reflector mounted at least partially under the second heater, surrounding the first reflector, so as to reflect heat and light emitted from the second heater toward the plate, wherein the second reflector causes multiple images of the second heater to be formed on the plate.

5. The cooking apparatus of claim 4, wherein the first reflector comprises:

a first reflective surface located under the center of the first heater; and a second reflective surface that is located at least partially outside a circumference of the ring shaped first heater, and wherein the second reflector comprises:

a third reflective surface located on a first side of the second heater; and a fourth reflective surface located on a second side of the second heater, wherein each of the first and second reflective surfaces of the second reflector is arcuate.

6. A cooking apparatus, comprising:

a plate configured to receive an object to be heated thereon;

a heater comprising a single ring shaped heating element mounted under the plate; and a reflector mounted at least partially below the heater, wherein the reflector reflects heat and light emitted from the heater toward the plate, wherein the reflector comprises:

a dome that projects towards a center of the single ring shaped heating element; and a plurality of concentric convex bands formed on the dome, wherein the plurality of convex bands are positioned within a periphery of the single ring shaped heating element so as to reflect multiple images of single the ring shaped heating element on the plate.

7. The cooking apparatus of claim 6, wherein the reflector comprises a reflective surface having at least two portions with different curvatures, and wherein each of at least the two portions forms a separate image of the heater on the plate.

8. The cooking apparatus of claim 7, wherein at least the two portions have centers of curvature located on a side of the reflective surface opposite the heater.

9. The cooking apparatus of claim 6, wherein the reflector comprises:

a first reflective surface located on a first side of the heater; and a second reflective surface located on a second side of the heater, and wherein each of the first and second surfaces are arcuate.

10. The cooking apparatus of claim 6, wherein the reflector includes an overheating protection portion located under the heater, and wherein the overheating protection portion prevents heat from being reflected directly back towards the heater.

11. The cooking apparatus of claim 6, wherein a plurality of concentric convex bands are formed on the dome, and wherein each convex band forms a separate image of the single ring shaped heating element on the plate.

12. The cooking apparatus of claim 6, wherein the heater comprises a first single ring shaped heating element, and the reflector comprises a first reflector, and further comprising:

a second heater that operates independently from the first heater, wherein the second heater is mounted under the plate, the second heater comprising a second single ring shaped heating element surrounding the first single ring shaped heating element; and a second reflector mounted at least partially under the second heater so as to reflect heat and light emitted from the second heater toward the plate, wherein the second reflector causes multiple images of the second single ring shaped heating element to be formed on the plate.

13. The cooking apparatus of claim 12, wherein the first reflector comprises:

a first reflective surface located under the center of the first single ring shaped heating element; and a second reflective surface that is located at least partially outside a circumference of the first single ring shaped heating element, and wherein the second reflector comprises:

a third reflective surface located on a first side of the second single ring shaped heating element; and a fourth reflective surface located on a second side of the second single ring shaped heating element, wherein each of the first and second surfaces of the second reflector is arcuate.

14. A cooking apparatus, comprising:

a plate configured to receive thereon an object to be heated;

a heater comprising a single ring shaped heating element mounted under the plate; and a reflector mounted at least partially below the heater so as to reflect heat and light emitted by the heater toward the plate, wherein the reflector comprises a dome that projects from a bottom wall of the reflector towards a center of the single ring shaped element, and wherein the single ring shaped heating element is positioned around the dome such that the reflector reflects multiple images of the single ring shaped heating element onto the plate.

15. The cooking apparatus of claim 14, wherein the reflector comprises a reflective surface on a side thereof facing the heater, the reflective surface having at least two portions with different curvatures, and wherein each of at least the two portions forms a separate image of the heater on the plate.

16. The cooking apparatus of claim 15, wherein at least the two portions have centers of curvature located at a side of the reflector opposite the side thereof facing the heater.

17. The cooking apparatus of claim 14, wherein the reflector comprises:

a first reflective surface facing an outer periphery of the single ring shaped heating element; and a second reflective surface facing an inner periphery of the sing ring shaped heating element, wherein each of the first and second surfaces is arcuate.

18. The cooking apparatus of claim 14, wherein the reflector includes an overheating protection portion located under the heater, and wherein the overheating protection portion prevents heat from being reflected directly back towards the heater.

* * * * *